US007459592B2

(12) United States Patent
Wolf et al.

(10) Patent No.: US 7,459,592 B2
(45) Date of Patent: Dec. 2, 2008

(54) COMPOSITION AND METHOD FOR TERMINAL BLENDING OF GASOLINES

(75) Inventors: Leslie R. Wolf, Naperville, IL (US); Adam J. Schubert, Naperville, IL (US)

(73) Assignee: BP Corporation North America Inc., Warrenville, IL (US)

( * ) Notice: Subject to any disclaimer, the term of this patent is extended or adjusted under 35 U.S.C. 154(b) by 627 days.

(21) Appl. No.: 11/016,085

(22) Filed: Dec. 17, 2004

(65) Prior Publication Data

US 2005/0143609 A1 Jun. 30, 2005

Related U.S. Application Data

(60) Provisional application No. 60/532,270, filed on Dec. 23, 2003.

(51) Int. Cl.
*C10L 1/16* (2006.01)

(52) U.S. Cl. ..... 585/14

(58) Field of Classification Search ..... 585/14
See application file for complete search history.

(56) References Cited

U.S. PATENT DOCUMENTS

| | | | | |
|---|---|---|---|---|
| 5,593,567 | A * | 1/1997 | Jessup et al. | 208/46 |
| 5,837,126 | A | 11/1998 | Jessup et al. | 208/16 |
| 6,241,791 | B1 * | 6/2001 | Trotta et al. | 44/451 |
| 6,328,772 | B1 | 12/2001 | Scott et al. | 44/451 |
| 2002/0014035 | A1 | 2/2002 | Scott et al. | 44/451 |
| 2002/0068842 | A1 * | 6/2002 | Brundage et al. | 585/14 |
| 2003/0173250 | A1 | 9/2003 | Blackwood et al. | 208/16 |

* cited by examiner

*Primary Examiner*—Walter D Griffin
*Assistant Examiner*—Frank C Campanell
(74) *Attorney, Agent, or Firm*—James R. Henes

(57) ABSTRACT

Methods for producing mid-grade and premium gasolines at a terminal from a seasonally adjusted high-octane blend stock are disclosed. Compositions useful as the high-octane blending stock also are disclosed.

27 Claims, No Drawings

COMPOSITION AND METHOD FOR TERMINAL BLENDING OF GASOLINES

This application claims the benefit of the provisional U.S. Application Ser. No. 60/532,270, filed Dec. 23, 2003.

FIELD OF THE INVENTION

The invention relates to the blending of finished gasolines in non-refinery environments. More specifically the invention relates to the blending of finished gasolines or the preparation of blend stocks for oxygenate blending from a limited number of components in an environment such as a terminal.

BACKGROUND OF THE INVENTION

Service stations owners often desire to offer their customers a choice of gasolines such as regular, mid-grade and premium gasolines. In most cases, they prefer that the higher grades be proprietary blends or include proprietary or at least advantageous additive packages to provide for better performance, lower emissions or fuel economy. Unfortunately, the economics of gasoline distribution sometimes argues against offering such a slate of products.

Historically, where a refiner produced a proprietary premium grade gasoline product at its refinery, that material was segregated in the pipeline distribution system so that it could be delivered to the terminal as the proprietary premium grade product. The proprietary product then would be stored in segregated tanks at the terminal, and shipped from the terminal as required by individual service stations.

In this case, for a refiner to offer a proprietary premium gasoline, the refiner must have adequate refining capacity to produce the proprietary gasoline, must pay to have the entire volume of proprietary gasoline shipped to terminal, must store the entire volume of the premium gasoline batch at the terminal for distribution, and must distribute truckloads of the proprietary gasoline to the service station.

The cost of transporting a segregated proprietary fuel through a pipeline can be high. Each interface between a segregated proprietary fuel and more typical fungible material makes pipeline operation more difficult requiring pipeline operators to expend greater resources to transport the segregated product. In addition to pipeline costs generally proportional to the volume of segregated product, some segregated product is lost in the interfacial volume of material that generally separates a proprietary product from the more typical fungible material shipped through the pipeline.

Additionally, maintaining tankage sufficient to store large volumes of a proprietary gasoline at a terminal incurs still more capital and operational expense.

Furthermore, the recent use of hygroscopic gasoline oxygenates such as ethanol also has affected the historical role of terminals. Because of ethanol's affinity for water and the resulting potential for water contamination and related corrosion, it is highly desirable to ship an unfinished gasoline to a terminal for terminal blending with ethanol, thereby keeping ethanol from the refinery and pipeline environment. Terminal blending large volumes of proprietary products also places additional logistical and capital demands on a terminal.

While fungible pipeline premium gasolines offer an alternative to some of the disadvantages noted above, selling fungible premium fuels often can be undesirable from a marketing and performance standpoint for at least two reasons. First, the competitive advantage of providing the consumer a proprietary fuel product and its distinctive performance advantages is lost when a fungible product is sold. Second, the quality of the fungible product may not possess the quality or performance advantages that a fuels marketer may wish to promote.

Thus, while it remains desirable to offer a slate of proprietary or differentiated fuel products to gasoline consumers, what is needed is a way to minimize the costs associated with the manufacture and distribution of a variety of gasolines, preferably with characteristics as good or better as fungible mid-grade or premium gasolines.

SUMMARY OF THE INVENTION

We find that that a broad slate of finished gasoline products can be produced at a terminal or other post-refinery facility by combining a fungible regular gasoline or oxygenate-free blend stock with a second, seasonally adjusted terminal blend stock.

Producing differentiated gasolines in this manner allows mid- and premium grade differentiated gasolines to be produced at the terminal, on demand, rather than requiring the shipment of complete premium gasoline or oxygenate-free blend stocks ("BOBs") to the terminal for storage and later distribution. Producing mid-grade and premium gasolines in this manner can substantially reduce pipeline shipping volumes and inventory requirements, and can increase product slate flexibility at the terminal.

The process also can reduce the loss of interfacial volume when shipping differentiated products through the pipeline when compared to the shipment of regular and premium finished gasolines or BOBs.

In a first embodiment of our invention, a gasoline or BOB of increased octane is made by blending, at a terminal, a seasonally adjusted high-octane terminal blend stock with a fungible regular grade gasoline or BOB.

As used in this application the term "high-octane terminal blend stock" or "HOBS" means a blend stock having an (R+M)/2 octane of 95 or more, and that is purposefully manufactured for blending, at a terminal, with a fungible regular grade gasoline or fungible regular grade BOB available from a pipeline or other source of fungible material.

The term "octane" as used herein means (R+M)/2 octane, also known as antiknock index (AKI), unless motor octane or research octane is specifically recited.

The word "terminal" as used in this application is meant to include gasoline blending terminals as well as any other non-refinery facility where a fungible gasoline or BOB may be blended with a second component to produce a product having a higher quality, such as a higher octane, than the fungible material. The word "terminal" does not include a service station site, such as where two components may be combined at the pump for distribution.

The term "fungible regular grade" when referring to a gasoline or a blend stock for oxygenate blending means that grade of gasoline or blend stock available from a pipeline or other source that is typically used as, or in the case of a BOB, blended to, a regular grade of finished gasoline.

The term "seasonally adjusted" when referring to a high-octane terminal blend stock means a blend stock that has been produced to have one or more volatility-related parameters falling within a range or limit for gasoline of a given type as set forth by an industry specification such as ASTM 4814 or local, state or federal regulation, such as the USEPA or the California Air Resources Board. Volatility-related parameters include but are not limited to direct measurements of physical properties such as Reid Vapor Pressure, measurements of fuel distillation characteristics such as $T_{10}$, $T_{50}$ or $T_{90}$, or combinations thereof, such as in the calculation of Driveability Index using a combination of $T_{10}$, $T_{50}$ and $T_{90}$, as well as vapor lock protection class as indicated by a test temperature that generates a maximum vapor/liquid ratio (V/L), such a the ASTM V/L of 20. Thus, for example, an ASTM 4814 Class AA-2 fuel, as described below, would have a seasonally adjusted $T_{10}$ if the $T_{10}$ was no more than 70° C., a seasonally adjusted RVP if the RVP was no more than 54 kilopascals (7.8 psi), a seasonally adjusted Driveability Index if its Driveability Index was no more than 597° C., and a seasonally adjusted V/L if its V/L was less than 20 at 56° C.

Where the term "blend stock for oxygenate blending", "oxygenate free blend stock" or "BOB" is used it refers to a blend stock which, when combined with an oxygenate, produces a finished gasoline (i.e., the addition of oxygenate is the only volumetrically substantial addition of hydrocarbonaceous material required to produce a finished gasoline.)

Preferably substantially all of the volatility related parameters of the high-octane blend stock are seasonally adjusted, such as in an ASTM 4814 compliant gasoline in which Reid Vapor Pressure, $T_{10}$, $T_{50}$, $T_{90}$, Driveability Index and V/L each have been seasonally adjusted. Seasonal adjustment of the HOBS in this manner assures that fungible regular grade gasolines or BOBs of varying composition can be mixed with the HOBS to produce a gasoline or BOB of higher finished octane which remains ASTM compliant for a given volatility class.

In many cases, the premium gasolines produced in this manner exhibit lower levels of potentially deleterious anthracenes, pyrenes and naphthalenes than are found in fungible premium gasolines.

In another embodiment of our invention, we produce at a terminal, a gasoline or BOB., of increased octane from a fungible regular gasoline or BOB by determining nominal values of required volatility parameters of the fungible regular gasoline or BOB and then preparing a high-octane terminal blend stock having volatility parameters such that, when blended with fungible regular gasoline or BOB having the nominal required volatility parameters, yields a gasoline or BOB within the required limits.

This process allows a refinery to take advantage of predictable deviations away from the maximum or minimum limits for a fungible regular fuel where the composition of that fuel is relatively constant. Where the volatility-related parameters of the regular fungible gasoline are not reliably known, the high-octane terminal blending stock can be prepared so that its volatility-related parameters are seasonally adjusted (i.e. within the limits for the given class of gasoline) for the unpredictable parameters, while allowing the volatility of the HOBS to vary more widely to take advantage of the predicted volatility-related parameters of the fungible base fuel. In this manner, when preparing an ASTM compliant fuel, up to five of Reid Vapor Pressure, $T_{10}$, $T_{50}$, $T_{90}$, V/L and Driveability Index in the HOBS may be seasonally adjusted.

In yet another embodiment of our invention, we provide a composition for terminal blending a mid-grade or premium gasoline or BOB having a known set of volatility requirements from a fungible or regular gasoline. The composition comprises a stream of mixed hydrocarbons having an octane of at least 95 and having a Reid Vapor Pressure, $T_{10}$, $T_{50}$, $T_{90}$, V/L and Driveability Index falling within the ASTM specifications for the finished gasoline into which the composition will be blended. Preferably the composition has as high an octane as practical, such as at least 95 and preferably 100 octane, more preferably 105 octane, and most preferably greater than 110 octane to minimize the amount of the component that needs to be transported, stored and mixed to produce the desired mid-grade or premium gasoline or BOB.

The composition typically includes the mixed refinery stream hydrocarbons selected from the group consisting of heavy reformate, isomerate, alkylate, light catalytically-cracked naphtha (also called "light cat naphtha" or "light catalytic naphtha"), toluene, light reformate, total reformate, butane and mixtures thereof.

DETAILED DESCRIPTION OF THE INVENTION

The examples of the invention described in detail below deal with the manufacture of gasolines for sale within the United States, a market in which gasoline requirements generally are set forth in ASTM Standard Specification Number D 4814-01a, as supplemented by certain federal and state regulations. While the following discussion is specific to ASTM D4814 gasolines, the invention is useful for producing differentiated gasolines in any environment where commercial or regulatory requirements must be met when producing a differentiated gasoline product.

The specifications for gasolines set forth in ASTM Standard Specification Number D 4814-01a, the disclosure of which is hereby incorporated by reference, vary based on a number of parameters affecting the volatility and combustion of gasoline, such as weather, season, geographic location and altitude. For this reason, gasolines produced in accordance with ASTM 4814 are broken into volatility categories AA, A, B, C, D and E, and vapor lock protection categories 1, 2, 3, 4, 5, and 6, each category having a set of specifications describing gasoline meeting the requirements of the respective classes. This specification also sets forth test methods for determining the foregoing parameters.

For example, a Class AA-2 gasoline blended for use during the summer driving season in relatively warm climates must have a maximum vapor pressure of 54 kPa (7.8 psi), a maximum temperature for distillation of 10 volume percent of its components (the "$T_{10}$") of 70 degrees Centigrade (158 degrees Fahrenheit), a temperature range for distillation of 50 volume percent of its components (the "$T_{50}$") of between 77 and 121 degrees Centigrade (158 to 250 degrees Fahrenheit), a maximum temperature for distillation of 90 volume percent of its components (the "$T_{90}$") of 190 degrees Centigrade (374 degrees Fahrenheit), a distillation end point of 190 degrees Centigrade (437 degrees Fahrenheit), a distillation residue maximum of 2 volume percent, a "Driveability Index" or "DI" maximum temperature of 597 degrees Centigrade (1250 degrees Fahrenheit), where DI is calculated as 1.5 times the $T_{10}$ plus 3.0 times the $T_{50}$ plus the $T_{90}$, and a maximum vapor to liquid ratio of 20 at a test temperature of 56 degrees Centigrade (133 degrees Fahrenheit).

Table 1a, below, lists the parameters recited above for each volatility class of gasoline AA through E and Table 1b lists the parameters for the vapor lock protection classes 1 through 6.

TABLE 1a

| Class | Vapor Press Max kPa (psi) | $T_{10}$ max ° C. (° F.) | $T_{50}$ min/max ° C. (° F.) | $T_{90}$ max ° C. (° F.) | End Point ° C. (° F.) | Distillation Residue v/o | DI ° C. (° F.) |
|---|---|---|---|---|---|---|---|
| AA | 54 (7.8) | 70 (158) | 77 (170) to 121 (250) | 190 (374) | 225 (437) | 2.0 | 597 (1250) |
| A | 62 (9.0) | 70 (158) | 77 (170) to 121 (250) | 190 (374) | 225 (437) | 2.0 | 597 (1250) |
| B | 69 (10.0) | 65 (149) | 77 (170) to 118 (245) | 190 (374) | 225 (437) | 2.0 | 591 (1240) |
| C | 79 (11.5) | 60 (140) | 77 (170) to 116 (240) | 185 (365) | 225 (437) | 2.0 | 586 (1230) |

TABLE 1a-continued

| Class | Vapor Press Max kPa (psi) | $T_{10}$ max ° C. (° F.) | $T_{50}$ min/max ° C. (° F.) | $T_{90}$ max ° C. (° F.) | End Point ° C. (° F.) | Distillation Residue v/o | DI ° C. (° F.) |
|---|---|---|---|---|---|---|---|
| D | 93 (13.5) | 55 (131) | 66 (150) to 113 (235) | 185 (365) | 225 (437) | 2.0 | 580 (1220) |
| E | 103 (15.0) | 50 (122) | 66 (150) to 110 (230) | 185 (365) | 225 (437) | 2.0 | 569 (1200) |

TABLE 1b

| Vapor lock protection class | Test Temperature, ° C. (° F.) | Vapor/Liquid Ratio (max) |
|---|---|---|
| 1 | 60 (140) | 20 |
| 2 | 56 (133) | 20 |
| 3 | 51 (124) | 20 |
| 4 | 47 (116) | 20 |
| 5 | 41 (105) | 20 |
| 6 | 35 (95) | 20 |

In addition to the volatility requirements set forth in ASTM 4814, gasolines typically must meet a minimum octane posted at the pump, typically (R+M/2) of 87 octane for "regular" gasoline and 91 to 93 octane for a "premium" gasoline. In many regions, refiners may offer a "mid-grade" gasoline having octane and additive packages placing the quality of the gasoline somewhere between regular and premium gasolines. A typical octane for a mid-grade gasoline is about 89 octane.

We find that substantial reduction in gasoline product shipping and storage costs can be accomplished by providing a terminal with a blending component of relatively high-octane. This blend stock is mixed with fungible regular grade gasoline at the terminal to provide on-demand production of mid-grade or premium gasoline, also reducing the need to maintain or create inventories of these finished fuels or their BOB equivalents.

In many instances, the mixing of the high-octane blend stock with fungible regular results in surprisingly lower amounts of undesired impurities when compared to fungible premium gasoline, providing further benefits to the gasoline consumer.

Unfortunately, blending any high-octane refinery component with fungible regular gasoline is not a viable method for producing a differentiated mid-grade or premium fuel product. The difficulty lies in the nature of typical high-octane fuel components and fungible regular fuel. Because any given quantity of fungible regular gasoline can vary within the ranges permitted by ASTM D-4812, many high-octane fuel components, even if available to a terminal, could not be used to produce a higher octane mid-grade or premium product because the blended material may cause a property of the finished fuel to fall outside one or more of the finished gasoline specifications of ASTM D-4814.

Thus, in accordance with our invention, we produce a seasonally adjusted high-octane blend stock that can be shipped in reduced volumes (when compared to an equivalent volume of premium fuel) and that can be blended with a fungible regular gasoline to yield a premium or mid-grade fuel meeting the volatility and octane requirements for a given season and market.

Because the high-octane blend stock is seasonally adjusted for volatility, it can be mixed in any ratio with fungible regular fuel without disturbing the volatility characteristics of the finished fuel. The seasonably adjusted component can, therefore, be used to produce either a differentiated mid-grade or premium fuel product within the range of ASTM-acceptable volatility, or could be used to produce an acceptable fuel of any octane between the octane of the fungible fuel and the seasonally adjusted component.

High-octane refinery streams that can be used to produce seasonally adjusted blending components useful in the invention include, but are not limited to, such streams as light catalytic naphtha, isomerates, light, heavy and total reformates, toluene and alkylates.

Examples 1-4 below illustrate the use of seasonally adjusted high-octane blending components in accordance with the invention to produce non-oxygenated premium gasolines at a terminal from a fungible regular grade gasoline. In Examples 1-4, the refinery streams used to prepare the high-octane blending components are butane, a mixture of heavy reformate and isomerate, alkylate, light catalytically-cracked naphtha and toluene.

EXAMPLE 1

In this Example, a seasonally adjusted high-octane blending stock (HOBS) consisting of 1 volume percent butane, 69 volume percent of a mixed heavy reformate/isomerate stream and 30 volume percent toluene is mixed with Class AA unleaded regular (ULR) fungible gasoline to produce a Class AA premium gasoline.

The properties of the mixed reformate/isomerate stream and the fungible regular gasoline are set out in Tables 2 and 3 below, respectively. The properties of the finished premium gasoline are set out in Table 4.

TABLE 2

| High-octane Blend Stock Properties | |
|---|---|
| RON (octane) | 103.84 |
| MON (octane) | 93.29 |
| (R + M)/2 (octane) | 98.56 |
| Reid Vapor Pressure or "RVP" (psi/kPa) | 7.45/51.4 |
| Anthracenes (ppm) | 5 |
| Pyrenes (ppm) | 5 |
| Naphthalenes (ppm) | 26,400 |
| Aromatics (volume percent) | 64.05 |
| Olefins (volume percent) | 1.14 |
| Sulfur (ppm) | 15.9 |
| Initial Boiling Point (° F./° C.) | 100.7/38.17 |
| $T_{10}$ (° F./° C.) | 129.6/54.22 |
| $T_{30}$ (° F./° C.) | 166.6/74.78 |
| $T_{50}$ (° F./° C.) | 207.0/97.22 |
| $T_{70}$ (° F./° C.) | 269.5/131.94 |
| $T_{90}$ (° F./° C.) | 360.8/182.67 |
| Final Boiling Point (° F./° C.) | 375.3/190.72 |
| Driveability Index (° F./° C.) | 1176/635.6 |
| V/L = 20 Temperature (° F./° C.) | 147/63.9 |

TABLE 3

| Fungible Regular Gasoline Properties | |
|---|---|
| RON (octane) | 91.6 |
| MON (octane) | 83.3 |
| (R + M)/2 (octane) | 87.0 |
| Reid Vapor Pressure (psi/kPa) | 7.73/53.3 |
| Anthracenes | 20 |
| Pyrenes | 19 |
| Naphthalenes | 69,300 |
| Aromatics (volume percent) | 29.3 |
| Olefins (volume percent) | Not measured |
| Sulfur (ppm) | 314 |
| Initial Boiling Point (° F./° C.) | 96.1/35.61 |
| $T_{10}$ (° F./° C.) | 130.3/54.61 |
| $T_{30}$ (° F./° C.) | 165.6/74.22 |
| $T_{50}$ (° F./° C.) | 216.2/102.33 |
| $T_{70}$ (° F./° C.) | 265.1/129.5 |
| $T_{90}$ (° F./° C.) | 338.7/170.39 |
| Final Boiling Point (° F./° C.) | 408.2/209 |
| Driveability Index (° F./° C.) | 1183/639.4 |
| V/L = 20 Temperature (° F./° C.) | 146/63.3 |

TABLE 4

| Premium Gasoline Properties (Example 1) | |
|---|---|
| ULR (volume percent) | 49 |
| HOBS (volume percent) | 51 |
| RON (octane) | Not measured |
| MON (octane) | Not measured |
| (R + M)/2 (octane) | 93 |
| Reid Vapor Pressure (psi/kPa) | 7.59/52.3 |
| Anthracenes | 12 |
| Pyrenes | 12 |
| Naphthalenes | 47,400 |
| Aromatics (volume percent) | 47 |
| Olefins (volume percent) | Not measured |
| Sulfur (ppm) | 170 |
| Initial Boiling Point (° F./° C.) | 98.4/36.89 |
| $T_{10}$ (° F./° C.) | 129.9/54.39 |
| $T_{30}$ (° F./° C.) | 166.1/74.5 |
| $T_{50}$ (° F./° C.) | 211.5/99.72 |
| $T_{70}$ (° F./° C.) | 267.3/130.72 |
| $T_{90}$ (° F./° C.) | 350.0/199.67 |
| Final Boiling Point (° F./° C.) | 391.4/637.2 |
| Driveability Index (° F./° C.) | 1179/637.2 |
| V/L = 20 Temperature (° F./° C.) | 146/63.3 |

As can be seen from Table 2, the seasonally adjusted high-octane blending stock is prepared so that each of $T_{10}$, $T_{50}$, $T_{90}$, the RVP, V/L and the Driveability Index are within the ASTM 4814 specifications for Class AA-1 gasoline. This ensures that when blended with fungible regular gasoline, the volatility of the blended premium gasoline will remain within ASTM specifications.

Using the high-octane blending component in accordance with the invention to terminal blend the premium grade gasoline requires only about one half the volume of pipeline shipped material when compared to the volume of premium gasoline that would have to be shipped if the gasoline was prepared at the refinery and shipped whole to the terminal.

Similarly, the amount of non-fungible material that needs to be stored at the terminal is reduced by about 50 percent when compared to premium gasoline, and further logistical advantages can be obtained by in-line blending the high-octane blending component via rack blending at the terminal when the premium gasoline is required for shipment (i.e. no need to inventory a finished premium gasoline).

COMPARATIVE EXAMPLE 1

Comparative Example 1 illustrates the reduction in polynuclear aromatics, specifically anthracenes, pyrenes and naphthalenes, when preparing a premium gasoline in accordance with the present invention.

Table 5 provides property data for a fungible premium gasoline marketed in Ohio and other Midwestern states as "Super 93." The data is believed to be representative of many fungible premium gasolines.

TABLE 5

| Fungible Unleaded Premium Properties | |
|---|---|
| RON (octane) | 98.3 |
| MON (octane) | 87.7 |
| (R + M)/2 (octane) | 93.0 |
| Reid Vapor Pressure (psi/kPa) | 9.27/63.9 |
| Anthracenes | 580 |
| Pyrenes | 533 |
| Naphthalenes | 96,949 |
| Aromatics (volume percent) | Not measured |
| Olefins (volume percent) | Not measured |
| Sulfur (ppm) | Not measured |
| Initial Boiling Point (° F./° C.) | 85.3/29.61 |
| $T_{10}$ (° F./° C.) | 127/52.78 |
| $T_{30}$ (° F./° C.) | 182.8/83.78 |
| $T_{50}$ (° F./° C.) | 232.4/111.33 |
| $T_{70}$ (° F./° C.) | 266/130 |
| $T_{90}$ (° F./° C.) | 329/165 |
| Final Boiling Point (° F./° C.) | 427.5/219.72 |
| Driveability Index (° F./° C.) | Not measured |

As can be seen by comparing the relative amounts of anthracenes, pyrenes and naphthalenes ("PNAs") in Table 5 to those in Table 4, preparing an unleaded premium gasoline using a seasonally adjusted high-octane blending component produced a premium gasoline having about 50 times less anthracenes and pyrenes, and about half the amount of naphthalenes.

Given the known detrimental affects of polynuclear aromatic compounds in fuel, it can be seen that a premium gasoline having superior properties can be prepared from a fungible unleaded regular blend stock. While not wishing to be bound by the theory, it is believed that the higher numbers of PNAs in the fungible premium result from the heavier reforming performed during preparation of the premium fuel or higher added levels of heavy reformate, steps not required in the preparation of fungible regular fuel.

Thus, the use of high-octane blending stock with a relatively modest quality regular fuel can yield surprising and unexpected fuel quality attributes in addition to providing for economic blending advantages.

EXAMPLE 2

In Example 2, a second, different seasonably adjusted high-octane blend stock is prepared and blended with the unleaded regular gasoline of Example 1 to yield an unleaded premium gasoline. The blending component is a mixture of 5 percent butane, 30 percent heavy reformate and 65 percent alkylate, and the properties of the blending component are set out in Table 6. The properties of the blended premium gasoline are set out in Table 7.

TABLE 6

| High-octane Blend Stock Properties | |
|---|---|
| RON (octane) | 99.12 |
| MON (octane) | 91.13 |
| (R + M)/2 (octane) | 95.12 |
| Reid Vapor Pressure (psi/kPa) | 7.36/50.7 |
| Anthracenes | 10 |
| Pyrenes | 10 |
| Naphthalenes | 52,400 |
| Aromatics (volume percent) | 30.06 |
| Olefins (volume percent) | 2.79 |
| Sulfur (ppm) | 10.6 |
| Initial Boiling Point (° F./° C.) | 94.1/34.5 |
| $T_{10}$ (° F./° C.) | 120.7/49.27 |
| $T_{30}$ (° F./° C.) | 174.7/79.27 |
| $T_{50}$ (° F./° C.) | 233.9/112.16 |
| $T_{70}$ (° F./° C.) | 301.7/149.83 |
| $T_{90}$ (° F./° C.) | 356.1/180.05 |
| Final Boiling Point (° F./° C.) | 379.9/193.27 |
| Driveability Index (° F./° C.) | 1239/670.5 |
| V/L = 20 Temperature (° F./° C.) | 150/65.5 |

TABLE 7

| Premium Gasoline Properties (Example 2) | |
|---|---|
| ULR (volume percent) | 28 |
| HOBS (volume percent) | 72 |
| RON (octane) | 99.12 |
| MON (octane) | 91.13 |
| (R + M)/2 (octane) | 95.12 |
| Reid Vapor Pressure (psi/kPa) | 7.36/50.7 |
| Anthracenes | 10 |
| Pyrenes | 10 |
| Naphthalenes | 52,400 |
| Aromatics (volume percent) | 30.06 |
| Olefins (volume percent) | 2.79 |
| Sulfur (ppm) | 10.6 |
| Initial Boiling Point (° F./° C.) | 94.1/34.5 |
| $T_{10}$ (° F./° C.) | 120.7/49.27 |
| $T_{30}$ (° F./° C.) | 174.7/79.27 |
| $T_{50}$ (° F./° C.) | 233.9/112.16 |
| $T_{70}$ (° F./° C.) | 301.7/149.83 |
| $T_{90}$ (° F./° C.) | 356.1/180.05 |
| Final Boiling Point (° F./° C.) | 379.9/193.27 |
| Driveability Index (° F./° C.) | 1239/670.5 |
| V/L = 20 Temperature (° F./° C.) | 149/65 |

As in Example 1, the seasonally high-octane blend stock is prepared so that each of $T_{10}$, $T_{50}$, $T_{90}$, V/L, the RVP and the Driveability Index are within the ASTM 4814 specifications for Class AA-1 gasoline.

Also in Example 1, Example 2 yields an ASTM compliant premium gasoline from the fungible unleaded gasoline. Although the volume reduction advantage is only about ⅓, as compared to ½ in Example 1, the 30% reduction still represents a substantial potential shipping and storage advantage over shipping a finished premium gasoline. Furthermore, the unexpected advantage of low PNA content is again evident.

EXAMPLE 3

In Example 3, a third, different seasonably adjusted high-octane blend stock is prepared and blended with the unleaded regular gasoline of Example 1 to yield an unleaded premium gasoline. The blending component is a mixture of 6 percent butane, 47 percent toluene and 47 percent alkylate, and the properties of the blend stock are set out in Table 8. The properties of the blended premium gasoline are set out in Table 9.

TABLE 8

| High-octane Blend Stock Properties (Example 3) | |
|---|---|
| RON (octane) | 106.16 |
| MON (octane) | 95.87 |
| (R + M)/2 (octane) | 101.02 |
| Reid Vapor Pressure (psi/kPa) | 7.49/51.6 |
| Anthracenes | 700 |
| Pyrenes | 700 |
| Naphthalenes | 29,100 |
| Aromatics (volume percent) | 47.4 |
| Olefins (volume percent) | 2.4 |
| Sulfur (ppm) | 7 |
| Initial Boiling Point (° F./° C.) | 98.6/37 |
| $T_{10}$ (° F./° C.) | 138.2/59 |
| $T_{30}$ (° F./° C.) | 198.3/92.38 |
| $T_{50}$ (° F./° C.) | 216.4/102.4 |
| $T_{70}$ (° F./° C.) | 223.4/106.3 |
| $T_{90}$ (° F./° C.) | 236.0/113.3 |
| Final Boiling Point (° F./° C.) | 324.5/162.5 |
| Driveability Index (° F./° C.) | 1092/588.8 |
| V/L = 20 Temperature (° F./° C.) | 153/67.2 |

TABLE 9

| Premium Gasoline Properties (Example 3) | |
|---|---|
| ULR (volume percent) | 60 |
| HOBC (volume percent) | 40 |
| RON (octane) | Not measured |
| MON (octane) | Not measured |
| (R + M)/2 (octane) | 93 |
| Reid Vapor Pressure (psi/kPa) | 7.63/52.6 |
| Anthracenes | 15 |
| Pyrenes | 15 |
| Naphthalenes | 53,200 |
| Aromatics (volume percent) | 36.5 |
| Olefins (volume percent) | Not measured |
| Sulfur (ppm) | 201 |
| Initial Boiling Point (° F./° C.) | 97.8/36.5 |
| $T_{10}$ (° F./° C.) | 136.0/57.7 |
| $T_{30}$ (° F./° C.) | 179.3/81.83 |
| $T_{50}$ (° F./° C.) | 215.6/102 |
| $T_{70}$ (° F./° C.) | 245.0/118.3 |
| $T_{90}$ (° F./° C.) | 298.5/148.05 |
| Final Boiling Point (° F./° C.) | 389.2/198.4 |
| Driveability Index (° F./° C.) | 1149/620.5 |
| V/L = 20 Temperature (° F./° C.) | 149/65 |

As in Examples 1 and 2, Example 3 yields an ASTM compliant premium gasoline from the fungible unleaded gasoline, a volume reduction of about 60 percent, and a relatively low PNA premium unleaded gasoline.

EXAMPLE 4

In Example 4, yet another, different seasonably adjusted high-octane blend stock is prepared and blended with the unleaded regular gasoline of Example 1 to yield an unleaded premium gasoline. The blending component is a mixture of 2 percent butane, 48 percent toluene and 50 percent light catalytic naphtha, and the properties of the blend stock are set out in Table 10. The properties of the blended premium gasoline are set out in Table 11.

TABLE 10

| High-octane Blend Stock Properties (Example 4) | |
|---|---|
| RON (octane) | 104.32 |
| MON (octane) | 91.42 |
| (R + M)/2 (octane) | 97.87 |

TABLE 10-continued

| High-octane Blend Stock Properties (Example 4) | |
|---|---|
| Reid Vapor Pressure (psi/kPa) | 7.57/52.2 |
| Anthracenes | 12 |
| Pyrenes | 13 |
| Naphthalenes | 43,100 |
| Aromatics (volume percent) | 52.3 |
| Olefins (volume percent) | 25.2 |
| Sulfur (ppm) | 139 |
| Initial Boiling Point (° F./° C.) | 98.3/36.83 |
| $T_{10}$ (° F./° C.) | 130.4/54.6 |
| $T_{30}$ (° F./° C.) | 172.1/77.83 |
| $T_{50}$ (° F./° C.) | 209.5/98.61 |
| $T_{70}$ (° F./° C.) | 230.6/110.3 |
| $T_{90}$ (° F./° C.) | 237.3/114.05 |
| Final Boiling Point (° F./° C.) | 303.4/150.7 |
| Driveability Index (° F./° C.) | 1061/571.6 |
| V/L = 20 Temperature (° F./° C.) | 147/63.8 |

TABLE 11

| Premium Gasoline Properties (Example 4) | |
|---|---|
| ULR (volume percent) | 50 |
| HOBS (volume percent) | 50 |
| RON (octane) | Not measured |
| MON (octane) | Not measured |
| (R + M)/2 (octane) | 93 |
| Reid Vapor Pressure (psi/kPa) | 7.65/52.7 |
| Anthracenes | 16 |
| Pyrenes | 16 |
| Naphthalenes | 56,200 |
| Aromatics (volume percent) | 40.8 |
| Olefins (volume percent) | Not measured |
| Sulfur (ppm) | 235 |
| Initial Boiling Point (° F./° C.) | 98.9/37.16 |
| $T_{10}$ (° F./° C.) | 135.8/57.6 |
| $T_{30}$ (° F./° C.) | 170.3/76.83 |
| $T_{50}$ (° F./° C.) | 211.8/99.8 |
| $T_{70}$ (° F./° C.) | 242.7/117.05 |
| $T_{90}$ (° F./° C.) | 286.5/141.38 |
| Final Boiling Point (° F./° C.) | 383.4/195.2 |

TABLE 11-continued

| Premium Gasoline Properties (Example 4) | |
|---|---|
| Driveability Index (° F./° C.) | 1126/607.7 |
| V/L = 20 Temperature (° F./° C.) | 147/63.8 |

As in the previous Examples, the seasonally adjusted high-octane blend stock combined with the fungible unleaded regular yields an ASTM-compliant premium fuel with substantial volumetric advantage and low PNAs.

EXAMPLES 5-8

Examples 5-8 illustrate how a Class E-5 gasoline can be produced according to our invention. The properties of the high-octane blend stock composition, the high-octane blend stock properties, and the properties of the blended gasoline are summarized below in Table 12 (HOBS component compositions), Table 13 (HOBS component properties) and Table 14 (blended gasoline properties). In each case, we calculate results using the fungible unleaded regular gasoline used in Example 1.

TABLE 12

HOBS Component Compositions (Examples 5-8)

| Refinery Stream | Example 5 (v/o) | Example 6 (v/o) | Example 7 (v/o) | Example 8 (v/o) |
|---|---|---|---|---|
| Butane | 12 | 17 | 17 | 13 |
| Heavy reformate plus isomerate | 72 | | | |
| Heavy reformate | | 30 | | |
| Alkylate | | 53 | 41.5 | |
| Toluene | 16 | | 41.5 | 37 |
| Light catalytic naphtha | | | | 50 |

TABLE 13

High-octane Blend Stock Properties (Examples 5-8)

| Parameter | Example 5 | Example 6 | Example 7 | Example 8 |
|---|---|---|---|---|
| RON (octane) | 99.9 | 98.5 | 104.42 | 101.43 |
| MON (octane) | 89.39 | 90.07 | 94.28 | 89.05 |
| (R + M)/2 (octane) | 94.64 | 94.29 | 99.25 | 95.24 |
| Reid Vapor Pressure (psi/kPa) | 14.76/101.8 | 14.78/101.9 | 14.4/99.3 | 14.66/101.1 |
| Anthracenes | 4 | 8 | 6 | 11 |
| Pyrenes | 5 | 8 | 6 | 13 |
| Naphthalenes | 19,900 | 48,400 | 34,500 | 37,600 |
| Aromatics (volume percent) | 51.8 | 29.8 | 41.9 | 41.4 |
| Olefins (volume percent) | 0.96 | 2.4 | 2.1 | 25.1 |
| Sulfur (ppm) | 17 | 8.8 | 6.2 | 139 |
| Initial Boiling Point (° F./° C.) | 77.1/25.05 | 68.6/20.3 | 74.5/23.61 | 76.9/24.94 |
| $T_{10}$ (° F./° C.) | 88.1/31.16 | 86.5/30.27 | 102.4/39.1 | 95.3/35.16 |
| $T_{30}$ (° F./° C.) | 138.0/58.8 | 140.0/60 | 160.6/71.4 | 139.7/59.83 |
| $T_{50}$ (° F./° C.) | 185.5/85.27 | 230.1/110.05 | 215.9/102.16 | 182.7/83.72 |
| $T_{70}$ (° F./° C.) | 258.5/125.83 | 310.3/154.61 | 235.6/113.11 | 220.4/104.6 |
| $T_{90}$ (° F./° C.) | 364.5/184.72 | 361.7/183.16 | 238.7/114.83 | 239.9/115.5 |
| Final Boiling Point (° F./° C.) | 381.2/194 | 377.6/192 | 316.3/157.94 | 305.9/152.16 |
| Driveability Index (° F./° C.) | 1053/567.2 | 1182/638.8 | 1040/560 | 931/499.4 |

TABLE 13-continued

| High-octane Blend Stock Properties (Examples 5-8) | | | | |
|---|---|---|---|---|
| Parameter | Example 5 | Example 6 | Example 7 | Example 8 |
| V/L = 20 Temperature (° F./° C.) | 106/41.1 | 112/44.4 | 116/46.6 | 108/42.2 |

TABLE 14

| Premium Gasoline Properties (Example 5-8) | | | | | |
|---|---|---|---|---|---|
| Parameter | ULR | Example 5 | Example 6 | Example 7 | Example 8 |
| ULR (volume percent) | 100 | 24 | 20 | 56 | 33 |
| HOBS (volume percent) | 0 | 76 | 80 | 44 | 67 |
| RON (octane) | 93.6 | Not measured | Not measured | Not measured | Not measured |
| MON (octane) | 81.9 | Not measured | Not measured | Not measured | Not measured |
| (R + M)/2 (octane) | | 93 | 93 | 93 | 93 |
| Reid Vapor Pressure (psi/kPa) | 14.75/101.7 | 14.76/101.8 | 14.77/101.83 | 14.6/100.7 | 14.69/101.3 |
| Anthracenes (ppm) | 9 | 5 | 8 | 8 | 10 |
| Pyrenes (ppm) | 10 | 6 | 8 | 8 | 12 |
| Naphthalenes (ppm) | 29,800 | 22,300 | 44,700 | 31,900 | 35,000 |
| Aromatics (volume percent) | 35.6 | 47.9 | 31 | 38.4 | 39.5 |
| Olefins (volume percent) | Not measured | Not measured | Not measured | Not measured | Not measured |
| Sulfur (ppm) | 251 | 73 | 57 | 143 | 17 |
| Initial Boiling Point (° F./° C.) | 80.1/26.72 | 77.8/25.4 | 70.9/21.61 | 87.0/30.5 | 79.4/26.3 |
| $T_{10}$ (° F./° C.) | 100.8/38.2 | 91.1/32.83 | 89.3/31.83 | 103.4/39.6 | 102.3/39.05 |
| $T_{30}$ (° F./° C.) | 149.6/65.3 | 140.8/60.4 | 141.9/61.05 | 154.8/68.2 | 144.2/62.3 |
| $T_{50}$ (° F./° C.) | 201.5/94.16 | 189.3/87.38 | 224.4/106.8 | 207.1/97.27 | 187.6/86.4 |
| $T_{70}$ (° F./° C.) | 256.7/124.83 | 258.1/125.61 | 299.6/148.6 | 243.3/117.38 | 225.7/107.61 |
| $T_{90}$ (° F./° C.) | 333.6/167.5 | 357.1/180.61 | 356.1/180.05 | 295.4/146.3 | 272.7/133.72 |
| Final Boiling Point (° F./° C.) | 403.1/206.16 | 386.5/196.94 | 382.7/194.83 | 378.0/192.2 | 366.8/186 |
| Driveability Index (° F./° C.) | 1089/587.2 | 1062/572.2 | 1163/628.3 | 1072/577.7 | 989/531.6 |
| V/L = 20 Temperature (° F./° C.) | 112/44.4 | 111/43.8 | 112/44.4 | 114/45.5 | 110/43.3 |

As can be seen be comparing the high-octane blend stock properties in Table 13 with the requirements for Class E-5 volatility in Table 1, each of the high-octane blend stocks used in Examples 5-8 exhibit distillation characteristics within the requirements for a Class E gasoline. Combining those blend components with a fungible regular gasoline yields a Class E-5 finished gasoline having an octane sufficient for a premium grade fuel and exhibiting PNA levels that are reduced from the nominal PNAs expected in a fungible premium fuel. Additional, the premium fuels can be prepared by transferring substantially less volume (between 20 and 54 percent) of material through a pipeline system, again a volumetric reduction that can substantially lower pipeline shipping costs.

The advantages afforded by terminal preparation of premium grade fuels are even more apparent in the production of mid-grade fuels. Because the octane increase from fungible unleaded regular fuel to a mid-grade octane of about 89 is substantially less than the increase required to prepare a 93 octane premium fuel, the amount of high-octane blending component required to produce a mid-grade fuel is substantially less for a given HOBS composition.

Furthermore, because both mid-grade and premium gasolines can be prepared from the same seasonally adjusted HOBS, a terminal has substantial flexibility in meeting volumetric requirements for each grade of gasoline.

Examples of Class AA-1 and Class E-5 mid-grade fuels prepared using the same high-octane blend components and fungible unleaded regular gasoline used in Examples 1-8 above appear as Examples 9-16 below. Because the HOBS are the same, only the data summarizing the final fuel composition characteristics is presented in Table 15 (Class AA-1 Examples 9-12) and Table 16 (Class E-5 Examples 13-16).

TABLE 15

Mid-Grade Gasoline Properties (Example 9-12, Class AA-1)

| Parameter | ULR | Example 9 | Example 10 | Example 11 | Example 12 |
|---|---|---|---|---|---|
| ULR (volume percent) | 100 | 86 | 80 | 89 | 87 |
| HOBC (volume percent) | 0 | 76 | 80 | 44 | 67 |
| RON (octane) | 91.6 | Not measured | Not measured | Not measured | Not measured |
| MON (octane) | 83.3 | Not measured | Not measured | Not measured | Not measured |
| (R + M)/2 (octane) | | 89 | 89 | 89 | 89 |
| Reid Vapor Pressure (psi/kPa) | 7.73/53.3 | 7.56/52.1 | 7.66/52.8 | 7.7/53.1 | 7.71/53.2 |
| Anthracenes (ppm) | 20 | 17.9 | 18 | 18.57 | 18.96 |
| Pyrenes (ppm) | 19 | 17.04 | 17.20 | 17.68 | 18.22 |
| Naphthalenes (ppm) | 69,300 | 63,294 | 65,920 | 64,878 | 65,894 |
| Aromatics (volume percent) | 29.3 | 34.2 | 29.4 | 31.3 | 32.3 |
| Olefins (volume percent) | Not measured | Not measured | Not measured | Not measured | Not measured |
| Sulfur (ppm) | 314 | 273 | 253 | 280 | 291 |
| Initial Boiling Point (° F./° C.) | 96.1/35.61 | 100.4/3.8 | 95.8/35.4 | 96.3/35.72 | 96.8/36 |
| T10 (° F./° C.) | 130.3/54.61 | 133.4/56.3 | 128.9/53.83 | 130.9/54.94 | 131.7/55.38 |
| T30 (° F./° C.) | 165.6/74.2 | 173.3/78.5 | 166.9/74.94 | 167.1/75.05 | 166.8/74.8 |
| T50 (° F./° C.) | 216.2/102.3 | 222.7/105.94 | 218.7/103.72 | 216.1/102.27 | 215.0/101.6 |
| T70 (° F./° C.) | 265.1/129.5 | 272.5/133.61 | 270.3/132.38 | 262.9/128.27 | 259.2/126.22 |
| T90 (° F./° C.) | 338.7/170.38 | 354.0/178.8 | 341.1/171.72 | 334.2/167.8 | 325.1/162.83 |
| Final Boiling Point (° F./° C.) | 408.2/209 | 403.2/206.2 | 404.1/206.72 | 406.1/207.83 | 401.8/205.4 |
| Driveability Index (° F./° C.) | 1183/639.4 | 1222/661.1 | 1191/643.8 | 1179/637.2 | 1168/631.1 |
| V/L = 20 Temperature (° F./° C.) | 146/63.3 | 149/65 | 147/63.8 | 147/63.8 | 146/63.3 |

TABLE 16

Mid-Grade Gasoline Properties (Example 13-16, Class E-5)

| Parameter | ULR | Example 13 | Example 14 | Example 15 | Example 16 |
|---|---|---|---|---|---|
| ULR (volume percent) | 100 | 82 | 81 | 90 | 85 |
| HOBC (volume percent) | 0 | 18 | 19 | 10 | 15 |
| RON (octane) | 93.6 | Not measured | Not measured | Not measured | Not measured |
| MON (octane) | 81.9 | Not measured | Not measured | Not measured | Not measured |
| (R + M)/2 (octane) | | 89 | 89 | 89 | 89 |
| Reid Vapor Pressure (psi/kPa) | 14.75/101.7 | 14.77/101.83 | 14.77/101.83 | 14.72/101.5 | 14.74/101.6 |
| Anthracenes (ppm) | 9 | 8.1 | 8.8 | 8.7 | 9.3 |
| Pyrenes (ppm) | 10 | 9.1 | 9.6 | 9.6 | 10.5 |
| Naphthalenes (ppm) | 29,800 | 28,018 | 33,334 | 30,270 | 30,970 |
| Aromatics (volume percent) | 35.6 | 38.5 | 34.5 | 36.2 | 36.5 |
| Olefins (volume percent) | Not measured | Not measured | Not measured | Not measured | Not measured |
| Sulfur (ppm) | 251 | 209 | 205 | 227 | 225 |
| Initial Boiling Point (° F./° C.) | 80.1/26.72 | 78.0/25.5 | 77.9/25.5 | 79.6/26.4 | 79.9/26.61 |
| $T_{10}$ (° F./° C.) | 98.1/36.72 | 98.0/36.6 | 98.0/39.6 | 103.4/39.6 | 101.1/38.38 |
| $T_{30}$ (° F./° C.) | 149.6/65.3 | 147.8/64.3 | 147.7/64.27 | 150.7/65.94 | 148.3/64.61 |
| $T_{50}$ (° F./° C.) | 201.5/94.16 | 206.6/97 | 206.9/97.16 | 202.8/94.8 | 198.4/92.4 |
| $T_{70}$ (° F./° C.) | 256.7/124.83 | 266.4/130.2 | 266.9/130.5 | 253.7/123.16 | 249.8/121 |
| $T_{90}$ (° F./° C.) | 333.6/167.5 | 338.7/170.38 | 338.9/170.5 | 324.9/162.72 | 320.0/160 |
| Final Boiling Point (° F. /° C.) | 403.1/206.16 | 398.5/203.61 | 398.3/203.5 | 397.4/203 | 395.1/201.72 |
| Driveability Index (° F./° C.) | 1089/587.2 | 1106/596.6 | 1107/597.2 | 1085/585 | 1067/575 |
| V/L = 20 Temperature (° F./° C.) | 112/44.4 | 112/44.4 | 112/44.4 | 112/44.4 | 111/43.8 |

Examples 9-16 demonstrate that a refiner can prepare an ASTM compliant mid-grade gasoline from a seasonally adjusted high-octane blend stock and a fungible regular gasoline. In these cases, the volumetric requirements of material used to differentiate the fungible unleaded regular fuel are typically only on the order of 10 to 15 percent of the volume of the finished fuel.

The invention can also be used to make oxygenated fuels such as the ethanol-containing fuels discussed in Examples 17 through 20, below. In these Examples Class AA and E premium and mid-grade blends for oxygenate blending ("BOBs") are prepared at the terminal for blending into a finished, oxygenated gasoline at the terminal.

BOBs prepared for ethanol blending typically will need to exhibit a lower Reid Vapor Pressure than the finished gasoline because of the relatively higher blending RVP of ethanol. It should be noted that in some cases an EPA waiver may be obtained to allow for RVP relief on the order of about 1 psi, and where this is possible, it should be taken advantage of and the RVP of the BOB adjusted accordingly.

Fortunately, ethanol provides a relatively high blending octane. This means that BOBs prepared for ethanol blending will have lower octane requirements than the finished fuel requirements.

A ten percent by volume ethanol content is often a target for reformulated gasolines. The RVP and octane requirements for BOB's for regular, mid-grade and premium blending with ten volume percent ethanol for Class AA and Class E gasolines are set forth in Table 17 below.

TABLE 17

Typical BOB Requirements for 10 percent ethanol blending

| Fuel type | Octane (R + M)/2 | RVP max (psi/kPa) Class AA | RVP max (psi/kPa) Class E |
|---|---|---|---|
| Unleaded regular | 83.8 | 5.9/40.7 | 14.3/98.6 |
| Unleaded mid-grade | 86.7 | 5.9/40.7 | 14.3/98.6 |
| Unleaded premium (Class AA) | 90.3 | 5.9/40.7 | 14.3/98.6 |
| Unleaded premium (Class E) | 90.8 | 5.9/40.7 | 14.3/98.6 |

EXAMPLES 17-20

Examples 17-20 below demonstrate the blending of BOB's for Class AA and E premium and mid-grade gasolines in accordance with the present invention. In each case, the high-octane blending component has the compositional make-up set forth in Table 18. Example 17 and 19 illustrate blending of a premium and a mid-grade Class AA BOB, respectively, while Example 18 and 20 illustrate blending of a premium and a mid-grade Class E BOB, respectively.

TABLE 18

HOBS Component Compositions

| Refinery Stream | Example 17 and 19 (Class AA) | Example 18 and 20 (Class E) |
|---|---|---|
| Butane (v/o) | 1 | 14 |
| Heavy reformate plus isomerate (v/o) | 17.25 | 18.0 |
| Heavy reformate (v/o) | 7.5 | 7.5 |
| Alkylate (v/o) | 30.5 | 25 |
| Toluene (v/o) | 31.25 | 23 |
| Light catalytic Naphtha (v/o) | 12.5 | 12.5 |

The respective high-octane blend stock properties are listed in Table 19, below, and the finished BOB properties in Table 20.

TABLE 19

High-octane BOB Blend Stock Properties

| Parameter | Example 17 and 19 (Class AA) | Example 18 and 20 (Class E) |
|---|---|---|
| RON (octane) | 103.5 | 101.0 |
| MON (octane) | 93.0 | 90.7 |
| (R + M)/2 (octane) | 98.3 | 95.9 |
| Reid Vapor Pressure (psi/kPa) | 5.82/40.1 | 14.2/97.9 |
| Anthracenes | 8 | 8 |
| Pyrenes | 9 | 8 |
| Naphthalenes | 41,065 | 35,245 |
| Aromatics (volume percent) | 48.5 | 40.1 |
| Olefins (volume percent) | 8.0 | 7.7 |
| Sulfur (ppm) | 43 | 43 |
| Initial Boiling Point (° F./° C.) | 102.7/39.27 | 71.1/21.72 |
| $T_{10}$ (° F./° C.) | 88.1/31.16 | 86.5/30.27 |
| $T_{30}$ (° F./° C.) | 134.7/57.05 | 91.5/33.05 |
| $T_{50}$ (° F./° C.) | 218.9/103.83 | 200.9/93.83 |
| $T_{70}$ (° F./° C.) | 241.3/116.27 | 238.6/114.7 |
| $T_{90}$ (° F./° C.) | 335.8/168.7 | 342.4/172.4 |
| Final Boiling Point (° F./° C.) | 372.7/189.27 | 373.9/189.94 |
| Driveability Index (° F./° C.) | 1194/645.5 | 1082/583.3 |
| V/L = 20 Temperature (° F./° C.) | Not measured | Not measured |

TABLE 20

BOB Properties for 10 vol. Percent Ethanol Blending (Examples 17-20)

| Parameter | Examples 17 and 19 (ULR Class AA) | Examples 18 and 20 (ULR Class E) | Example 17 (Class AA Premium) | Example 18 (Class E Premium) | Example 19 (Class AA Mid-grade) | Example 20 (Class E Mid-grade) |
|---|---|---|---|---|---|---|
| ULR (volume percent) | 100 | 100 | 57 | 48 | 81 | 77 |
| HOBS (volume percent) | 0 | 0 | 43 | 52 | 19 | 23 |
| RON (octane) | 88.1 | 88.5 | Not measured | Not measured | Not measured | Not measured |
| MON (octane) | 79.6 | 79.2 | Not measured | Not measured | Not measured | Not measured |
| (R + M)/2 (octane) | | | 90.3 | 90.3 | 86.7 | 86.7 |
| Reid Vapor Pressure (psi/kPa) | 5.69/39.2 | 14.2/97.9 | 5.75/39.6 | 14.2/97.9 | 5.72/39.4 | 14.2/97.9 |
| Anthracenes (ppm) | 6 | 7 | 7 | 7 | 6 | 7 |
| Pyrenes (ppm) | 6 | 9 | 7 | 8 | 6 | 8 |
| Naphthalenes (ppm) | 35,626 | 32,501 | 37,965 | 29,584 | 36,645 | 326,191 |
| Aromatics (volume percent) | 36.2 | 26.3 | 41.5 | 33.8 | 38.5 | 29.6 |
| Olefins (volume percent) | 2.32 | 2.22 | Not measured | 5.0 | Not measured | 3.5 |
| Sulfur (ppm) | 114 | 211 | 84 | 124 | 103 | 172 |
| Initial Boiling Point (° F./° C.) | 116.7/47.05 | 80.6/27 | 110.7/43.72 | 76.1/24.5 | 114.1/45.61 | 78.7/25.94 |
| $T_{10}$ (° F./° C.) | 145.9/63.27 | 103.2/39.5 | 141.0/60.5 | 97.1/36.16 | 143.7/62.05 | 100.5/38.05 |
| $T_{30}$ (° F./° C.) | 180.7/82.61 | 149.8/65.4 | 179.9/82.16 | 145.7/63.16 | 180.4/82.4 | 148.0/64.4 |
| $T_{50}$ (° F./° C.) | 225.4/107.4 | 194.1/90.05 | 222.6/105.8 | 197.6/92 | 224.2/106.7 | 195.6/90.8 |
| $T_{70}$ (° F./° C.) | 294.0/145.5 | 238.7/114.83 | 271.3/132.94 | 238.7/114.83 | 284.0/140 | 238.6/114.7 |
| $T_{90}$ (° F./° C.) | 346.4/174.6 | 318.3/159.05 | 341.8/172.11 | 330.1/165.61 | 344.3/173.5 | 323.9/162.16 |
| Final Boiling Point (° F./° C.) | 390.6/199.2 | 393.6/200.88 | 382.9/194.94 | 383.3/195.16 | 387.2/197.3 | 389.0/198.3 |
| Driveability Index (° F./° C.) | 1241/671.6 | 1055/568.3 | 1221/660.5 | 1069/576.1 | 1232/666.6 | 1061/571.6 |
| V/L = 20 Temperature (° F./° C.) | Not measured | Not measured | Not measured | Not measured | Not measured | Not measured |

As can be seen from Examples 17-20, use of the invention in the blending of a high-octane blending component with a fungible regular blend for oxygenate blending provides similar advantages to those for finished fuels. Again, the advantages include:

1) substantial reductions in the amount of material that must be moved to a terminal to produce a given volume of premium gasoline;
2) the attendant reductions in terminal storage requirements;
3) the flexibility provided by being able to use the same high-octane blending component to produce both a mid-grade and a premium product on demand; and
4) the ability to produce a low PNA premium fuel from unleaded regular fungible gasoline or BOB's.

While the foregoing Examples employ high-octane terminal blend stocks having Reid Vapor Pressure, $T_{10}$, $T_{50}$, $T_{90}$, V/L and Driveability Indices all within the requirements for a given volatility class of gasoline, it should be appreciated that not every volatility-related parameter required by regulation, law or standard for the finished gasoline must be met by the HOBS. It is only necessary in accordance with our invention to deliberately prepare a HOBS for use at the terminal that has at a minimum one volatility parameter within those specified for a given gasoline as long as the finished gasoline complies with all volatility-related requirements for that class of gasoline. It nevertheless is preferable where possible to meet as many volatility related parameters as possible where this does not impose an economic penalty.

An example of where a HOBS may not be necessary to meet all volatility requirements for a given class of finished gasoline is where, in a given season, fungible gasoline has a fairly predictable composition with respect to one or more volatility-related parameters. In this case, relatively assured that certain volatility parameters of the fungible regular gasoline or BOB are a known increment away from an applicable limit, it is possible to adjust or allow volatility-related parameters of the HOBS outside the volatility limits for a given class by an amount that is up to the "cushion" afforded by the predictable value of the parameter in the fungible fuel, as long as the finished gasoline complies with all required volatility-related parameters. In this case, it may not be necessary for any of the HOBS volatility-related parameters to be within the limits for the finished gasoline or BOB, although such a scenario is believed to be unlikely.

For example, if the $T_{50}$ for a given fungible fuel in a given season was known to lie within a few degrees of the middle of the required 80 degree Fahrenheit $T_{50}$ range of ASTM 4814, it is possible to let the $T_{50}$ of the HOBS vary outside that amount by any increment that will yield a finished gasoline with a $T_{50}$ within the range. Exploiting the predictability of a fungible regular gasoline source in this manner will increase the flexibility of the component blends that can be used to make the HOBS at any given time of year, or for other reasons, such as during a major process unit outage, and potentially reduce the cost of HOBS or the cost of using HOBS when viewed from an integrated refining perspective.

As will be apparent to those of skill in the art, any number of gasoline additives may also be introduced into the fuel at the refinery into the HOBS or at the terminal in accordance with our invention. Such additives can include detergents, demulsifiers, corrosion inhibitors, deposit modifiers, deicers, antiknock compounds, antioxidants, metal deactivators, valve seat recession preventives, spark enhancers, combustion modifiers, friction modifiers, antifoam agents, conductivity improvers, oxygenates, static dissipaters and the like. One or more of these may be added to the finished gasoline products made in accordance with our invention to further differentiate the gasoline products from those manufactured by other refiners or to enhance the performance, efficiency or to reduce emissions from the finished gasoline products.

As also will be appreciated by those skilled in the art, any finished gasoline will need to comply with Federal, state or local environmental regulations. In some cases, those regulations may be in whole or in part emissions-based, such as the US EPA Complex Model for Reformulated Gasoline ("RFG") or the California Air Resources Board ("CARB") Predictive Model. Such models and related regulations may set different emissions criteria by region or by season, and where a gasoline is referred to as EPA-compliant or CARB-compliant within this application, it means that the gasoline meets all EPA or CARB requirements for the market into which it is being sold.

Gasolines, reformulated gasolines and BOBS having volatility requirements under other regulatory systems or industry standards may be analogously prepared in a manner to that described in the Examples and accompanying text. It is only necessary to know the volatility related parameters for the finished gasoline, and to produce a high-octane terminal blend stock that is seasonally adjusted as required for the finished gasoline to meet the regulations or standards for the finished gasoline.

The composition of the high-octane blending component is limited only by the available refinery streams that may be blended to produce the component having the desired seasonally adjusted volatility requirements, taking into account any other regulatory limits that may be impacted by the combination of the HOBS with the fungible base fuel. For example, where regulations set a maximum limit for sulfur or aromatics in a gasoline, care should be taken to ensure that finished gasoline will meet those regulatory requirements in addition to the volatility-related requirements.

Our invention as described in detail above is intended only to be exemplary, and the scope of our invention is therefore intended only to be limited by the scope of the following claims.

We claim:

1. A process for producing, at a terminal, a gasoline or BOB of increased octane and having required values of required volatility parameters, from a fungible relatively lower octane regular gasoline or BOB having nominal values of the aforesaid required volatility parameters; comprising:

a) producing in a refinery the aforesaid fungible regular grade gasoline or BOB having nominal values of the aforesaid required volatility parameters;

b) transporting the aforesaid fungible regular grade gasoline or BOB to a terminal; and c) blending at the terminal, the aforesaid fungible regular grade gasoline or BOB with an amount of a seasonally adjusted high-octane terminal blend stock having a value of at least one volatility parameter within the aforesaid required values of the aforesaid required volatility parameters of the aforesaid gasoline or BOB of increased octane, which amount is effective to afford the aforesaid gasoline or BOB of increased octane and having the required values of the required volatility parameters.

2. The process of claim 1 wherein the aforesaid gasoline or BOB of increased octane has required volatility parameters selected from the group consisting of Reid Vapor Pressure, T10, T50, T90, V/L and Driveability Index.

3. The process of claim 2 wherein the aforesaid gasoline or BOB of increased octane has required volatility parameters comprising Reid Vapor Pressure, T10, T50, T90, V/L and Driveability Index.

4. The process of claim 2 wherein the aforesaid fungible relatively lower octane regular gasoline or BOB has nominal values of the aforesaid required volatility parameters.

5. The process of claim 3 wherein the aforesaid fungible relatively lower octane regular gasoline or BOB has nominal values of the aforesaid required volatility parameters.

6. The process of claim 1 wherein the high-octane terminal blend stock has at least one seasonally adjusted volatility parameter selected from the group consisting of Reid Vapor Pressure, T10, T50, T90, V/L, and Driveability Index that falls within the ASTM specifications for the aforesaid required volatility parameters of the aforesaid gasoline or BOB of increased octane.

7. The process of claim 6 wherein the high-octane terminal blend stock has at least two seasonally adjusted volatility parameters selected from the group consisting of Reid Vapor Pressure, T10, T50, T90, V/L and Driveability Index that fall within the ASTM specifications for the aforesaid required volatility parameters of the aforesaid gasoline or BOB of increased octane.

8. The process of claim 7 wherein the high-octane terminal blend stock has at least three seasonally adjusted volatility parameters selected from the group consisting of Reid Vapor Pressure, T10, T50, T90, V/L and Driveability Index that fall within the ASTM specifications for the aforesaid required volatility parameters of the aforesaid gasoline or BOB of increased octane.

9. The process of claim 8 wherein the high-octane terminal blend stock has at least four seasonally adjusted volatility parameters selected from the group consisting of Reid Vapor Pressure, T10, T50, T90, V/L, and Driveability Index that fall within the ASTM specifications for the aforesaid required volatility parameters of the aforesaid gasoline or BOB of increased octane.

10. The process of claim 9 wherein the high-octane terminal blend stock has at least five seasonally adjusted volatility parameters selected from the group consisting of Reid Vapor Pressure, T10, T50, T90, V/L and Driveability Index that fall with the ASTM specifications for the aforesaid required volatility parameters of the aforesaid gasoline or BOB of increased octane.

11. The process of claim 10 wherein the high-octane terminal blend stock has Reid Vapor Pressure, T10, T50, T90, V/L and Driveability Index that fall within the ASTM specifications for the aforesaid required volatility parameters of the aforesaid gasoline or BOB of increased octane.

12. The process of claim 1 wherein the aforesaid gasoline or BOB of increased octane contains up to 50 volume percent of the aforesaid high-octane terminal blend stock.

13. The process of claim 12 wherein the aforesaid gasoline or BOB of increased octane contains up to 30 volume percent of the aforesaid high-octane terminal blend stock.

14. The process of claim 1 wherein the aforesaid gasoline or BOB of increased octane contains less than 300 ppm of anthracenes, less than 300 ppm of pyrenes, and less than 50,000 ppm of naphthalenes.

15. The process of claim 1 wherein the aforesaid gasoline or BOB of increased octane has an octane of at least 90.3.

16. The process of claim 15 wherein the aforesaid gasoline or BOB of increased octane has an octane of at least 93.

17. The process of claim 1 wherein the aforesaid high-octane terminal blend stock has an octane of at least 95.

18. The process of claim 17 wherein the aforesaid high-octane terminal blend stock has an octane of at least 100.

19. The process of claim 18 wherein the aforesaid high-octane terminal blend stock has an octane of at least 105.

20. The process of claim 1 wherein the aforesaid gasoline or BOB of increased octane is EPA-compliant.

21. The process of claim 1 wherein the aforesaid gasoline or BOB of increased octane is CARB-compliant.

22. The process of claim 1 further comprising the step of adding to the aforesaid gasoline or BOB of increased octane at the terminal one or more additives selected from the group consisting of detergents, demulsifiers, corrosion inhibitors, deposit modifiers, de-icers, antioxidants, metal activators, valve seat recession preventives, spark enhancers, combustion modifiers, friction modifiers, antifoam agents, conductivity additives, oxygenates, static dissipaters or anti-knock compounds.

23. The process of claim 1 wherein the high-octane terminal blend stock comprises a stream of mixed hydrocarbons comprising refinery stream hydrocarbons selected from the group consisting of heavy reformate, isomerate, alkylate, light catalytically-cracked naphtha, toluene, light reformate, total reformate, butane and mixtures thereof.

24. The process of claim 1 further comprising the step of blending the aforesaid gasoline or BOB of increased octane with ethanol to produce a finished gasoline blend containing from about 4 to about 12 volume percent of ethanol.

25. The process of claim 24 wherein the finished gasoline blend comprises at least 50 volume percent of the aforesaid fungible regular gasoline or BOB and from about 4 to about 11 volume percent of ethanol.

26. The process of claim 24 wherein the finished gasoline blend is EPA-compliant.

27. The process of claim 24 wherein the finished gasoline blend is CARB-compliant.

* * * * *